US007735578B2

(12) United States Patent
Loehr et al.

(10) Patent No.: US 7,735,578 B2
(45) Date of Patent: Jun. 15, 2010

(54) PERFORATING SYSTEM WITH SHAPED CHARGE CASE HAVING A MODIFIED BOSS

(75) Inventors: John D. Loehr, Needville, TX (US); Patrick R. Markwardt, Brenham, TX (US)

(73) Assignee: Baker Hughes Incorporated, Houston, TX (US)

( * ) Notice: Subject to any disclaimer, the term of this patent is extended or adjusted under 35 U.S.C. 154(b) by 69 days.

(21) Appl. No.: 12/027,765

(22) Filed: Feb. 7, 2008

(65) Prior Publication Data

US 2009/0200009 A1 Aug. 13, 2009

(51) Int. Cl.
*E21B 43/117* (2006.01)

(52) U.S. Cl. ..... 175/4.6; 166/297; 166/55.1

(58) Field of Classification Search ..... 175/4.6; 166/297, 55, 55.1
See application file for complete search history.

(56) References Cited

U.S. PATENT DOCUMENTS 3,094,930 A 6/1963 Blair
5,046,567 A * 9/1991 Aitken et al. ..... 175/4.6
5,590,723 A 1/1997 Walker et al.
5,952,603 A 9/1999 Parrott
6,487,973 B1 12/2002 Gilbert, Jr. et al.

* cited by examiner

*Primary Examiner*—Giovanna C Wright
(74) *Attorney, Agent, or Firm*—Bracewell & Guiliani LLP

(57) ABSTRACT

A perforating gun having a charge case with a boss element partially circumscribing Optionally the pair of bosses may be included that are substantially symmetric about the axis of the charge case. Forming a shaped charge with such a charge case allows for gun strips to be formed with increased web material between adjacent shape charges in the gun strips. The increased web material provides for a more structurally sound gun tube, especially when dealing with high density charges. Notches may be provided in the gun tube on the outer radius of the holes formed to receive the shape charges, the notches are to be aligned with the bosses on the outer periphery of the shaped charge case. This also may orient the charge cases so they are pre-aligned for ready connection to an associated detonation cord.

16 Claims, 4 Drawing Sheets

PERFORATING SYSTEM WITH SHAPED CHARGE CASE HAVING A MODIFIED BOSS

BACKGROUND

1. Field of Invention

The invention relates generally to the field of oil and gas production. More specifically, the present invention relates to a perforating system. Yet more specifically, the present invention relates to a shaped charge having a modified boss for use in a perforating gun system.

2. Description of Prior Art

Perforating systems are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore. The casing is retained in the wellbore by pumping cement into the annular space between the wellbore and the casing. The cemented casing is provided in the wellbore for the specific purpose of hydraulically isolating from each other the various earth formations penetrated by the wellbore.

Perforating systems typically comprise one or more perforating guns strung together, these strings of guns can sometimes surpass a thousand feet of perforating length. In FIG. 1 an example of a perforating system 4 is shown. For the sake of clarity, the system 4 depicted comprises a single perforating gun 6 instead of a multitude of guns. The gun 6 is shown disposed within a wellbore 1 on a wireline 5. The perforating system 4 as shown also includes a service truck 7 on the surface 9, where in addition to providing a raising and lowering means, the wireline 5 also provides communication and control connectivity between the truck 7 and the perforating gun 6. The wireline 5 is threaded through pulleys 3 supported above the wellbore 1.

Perforating guns typically include a cylindrical gun strip 16 coaxially housed within a gun body 14. Shaped charges 8 are provided within the gun strip 16 and aimed generally perpendicular to the axis of the wellbore 1. FIG. 2 provides an example of a shaped charge 8 that includes a housing 18, a liner 22, a quantity of high explosive 24 inserted between the liner 22 and the housing 18, and a booster charge 26 adjacent the base of the high explosive 24.

The shaped charges 8 are typically connected to a detonating cord 27 which is affixed to the shaped charge 8 by a case slot 25 proximate to the booster charge 26. Igniting the detonation cord 27 creates a compressive pressure wave along its length that initiates the booster charge 26 that in turn ignites the high explosive 24. When the high explosive 24 is detonated, the force of the detonation collapses the liner 22 and ejects it from one end of the charge 8 at very high velocity in a pattern called a "jet" 12. The jet 12 perforates the casing and cement lining the wellbore 1 and creates a perforation 10 that extends into the surrounding formation 2.

Shaped charges 8 also include a boss 20 protruding outward from the case 18 perpendicular to the axis $A_{SC}$ of the case 18. The boss 20 fully circumscribes the case 18 outer circumference. A perspective example of the gun strip 16 is provided in FIG. 3 illustrating holes 28 formed through the gun strip 16 for receiving shaped charges 8 therein. The shaped charge 8 is inserted into the hole 28 until the boss 20, whose outer diameter extends past the hole 28 outer diameter, contacts the outer surface of the gun strip 16. Thus the boss 20 supports the shaped charge 8 in the gun strip 16 and vertically aligns the shaped charge 8 in the gun strip 16. However, because the boss 20 is generally planar but the gun strip 16 outer diameter is curvilinear, the entire radius of the boss 20 does not lie above the hole 28, but instead the hole 28 outer diameter is shaped to accommodate the shaped charge 8 placement. Accordingly although the shaped charge 8 outer diameter is substantially circular, the typical gun tube 16 hole 28 is not. This can be a problem in certain perforating guns employing a "high density" shot pattern. For example, FIG. 3 illustrates an example of a gun tube 16 having high density shot pattern wherein adjacent holes 28 are sufficiently close that a web portion 30 between the holes 28 is too narrow to provide adequate structural support.

SUMMARY OF INVENTION

Disclosed herein is a perforating gun with a first shaped charge having a charge case, a liner, and explosive disposed between the liner and charge case. The perforating gun also includes an annular gun strip, a first boss on the charge case partially circumscribing the charge case outer periphery, a first hole formed through the side of the gun strip, and a landing on the gun strip and adjacent the hole formed to mateingly cooperate with the first boss. A second boss may optionally be provided on the charge case partially circumscribing the charge case outer periphery. The respective ends of the first and second boss may, in one embodiment, be substantially equidistant from one another. The lengths of the first and second boss may range from about 10% to about 30% of the charge case circumference. The length of the first and second boss may be about 20%. A second landing may be included on the gun strip and adjacent the hole formed to mateingly cooperate with the second boss. The charge case has an open end and a closed end, and an axis extending through the open and closed ends, the charge case being substantially symmetric about the axis. The gun strip may include a second hole in the gun strip adjacent to the first hole, a web defined by the portion of the gun strip body between the first hole and the second hole, a landing on the gun strip on the second hole perimeter, the landings being disposed away from the web. The web dimensions comprise structural integrity sufficient for a high density perforating gun. The perforating gun may further comprise a detonation cord coaxially extending through the gun strip, and a cord slot formed on the bottom end of the charge case formed for attachment with the detonation cord, the first boss and landing formed to align the cord slot with the detonation cord when inserted into the hole. The landing may comprise notches configured to mate with the respective ends of the first boss and a planar section between the notches.

Also disclosed herein is a method of forming a wellbore perforating device comprising, (a) providing a shaped charge with a first boss that partially circumscribes the shaped charge outer periphery, (b) providing a gun strip with a first hole and a first landing formed adjacent the hole edge, the landing configured to cooperatively mate with the first boss, (c) inserting the shaped charge into the gun strip hole, and (d) cooperatively mating the first boss with the first landing. The shaped charge in the method may further include a second boss partially circumscribing the shaped charge outer periphery and the gun strip may further include a second landing configured to cooperatively mate with the first boss, the method further comprising cooperatively mating the second boss with the second landing. The perforating device may further comprise a second shaped charge having a boss partially circumscribing its outer periphery, a second hole, a landing formed adjacent the second hole configured to cooperatively mate with the boss of the second shaped charge, and a web portion defined between the first and second hole, wherein the landings are disposed away from the web. The web dimensions are sufficient for use in a high density perforating gun application. The method may further comprise deploying the perforating device within a wellbore and initiating detonation of the shaped charges.

BRIEF DESCRIPTION OF DRAWINGS

Some of the features and benefits of the present invention having been stated, others will become apparent as the description proceeds when taken in conjunction with the accompanying drawings, in which.

Figure 2:
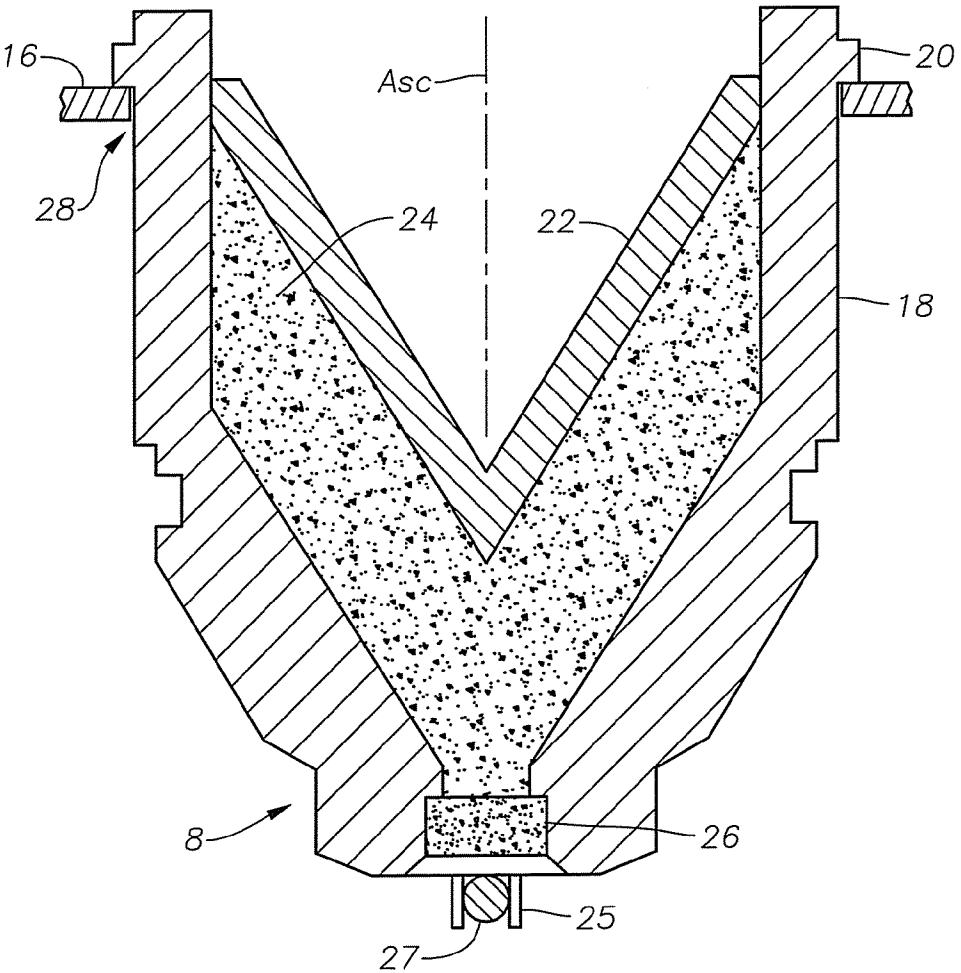
Fig. 2 (Prior Art)
FIG. 2 illustrates a cutaway view of a shaped charge.
Figure 1:
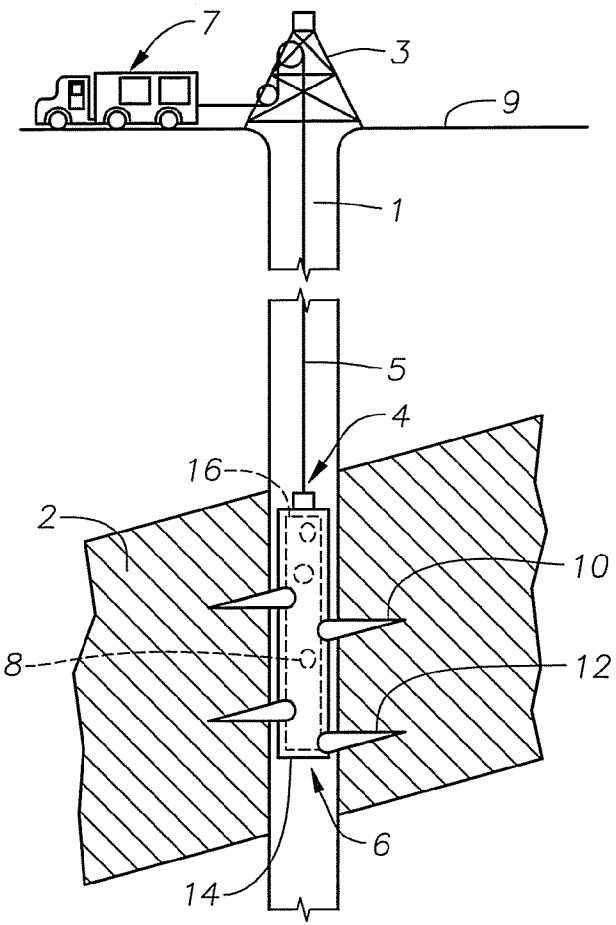
Fig. 1 (Prior Art)
FIG. 1 is partial cutaway side view of a prior art perforating system in a wellbore.
Figure 3:
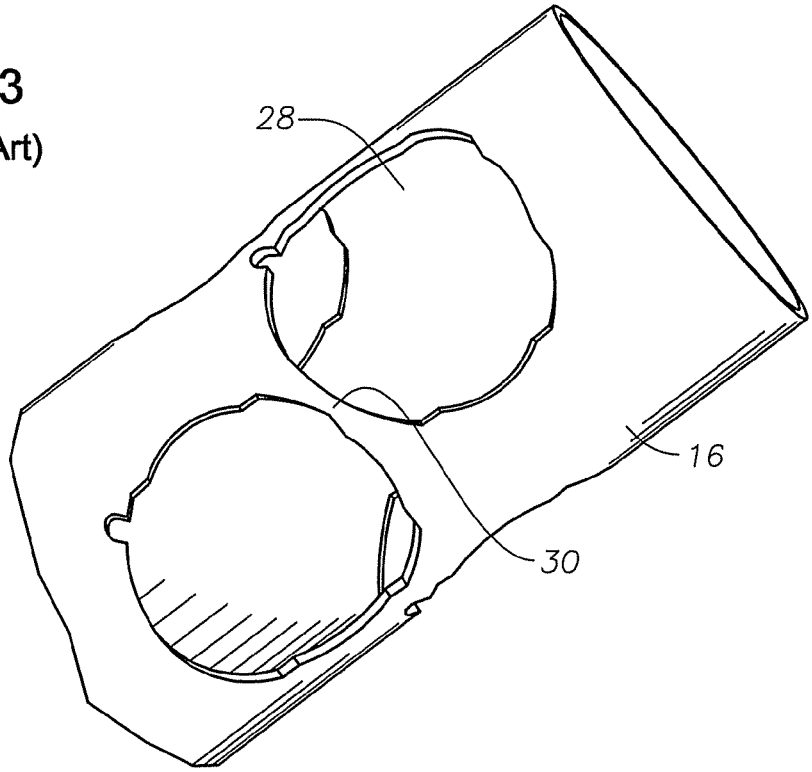
Fig. 3 (Prior Art)
FIG. 3 is a perspective view of a gun strip with holes for shaped charges.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

Figure 4:
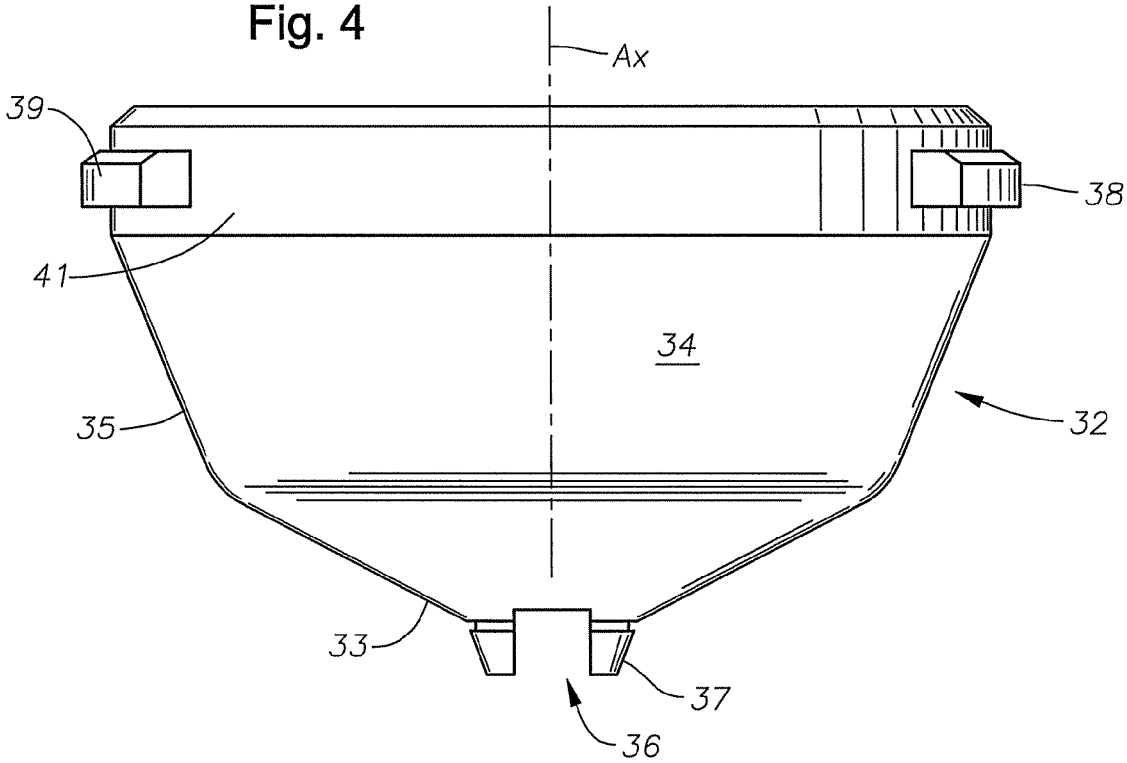
FIG. 4 is a side view of an embodiment of shaped charge case.

FIG. 4 is a side view of an embodiment of a charge case 32 for use in a shape charge of a perforating system. The case body 34 is a container-like structure having a bottom 33 sloping upward with respect to the axis $A_x$ of the charge case 32. The charge case 32 as shown is substantially symmetric about the axis $A_x$. In the embodiment shown, the case 32 transitions into the upper portion 35 where the case 32 outer surface slope steepens. The upper portion 35 also has a profile oblique to the axis $A_x$. Extending downward from the bottom portion 33 is a cord slot 36 having a pair of tabs 37. The tabs 37 are configured to receive a detonating cord therebetween and are generally parallel with the axis $A_x$ of the charge case 32.

A crown portion 41 defines the portion of the case body 34 extending from the upper terminal end of the upper portion 35. The upper most portion of the crown portion 41 defines the opening of the charge case 32 and lies in a plain that is largely perpendicular to the axis $A_x$. In the embodiment shown, the crown portion 41 has an outer surface extending generally parallel with the axis $A_x$. A boss element 38 is provided on the outer surface of the crown portion 41. The boss element 38 is an elongated member whose elongate section partially circumscribes a portion of the outer peripheral radius of the crown portion 41, and thus partially circumscribes the outer circumference of the charge case 32. In the embodiment shown, the boss element 38 cross section is largely rectangular and extends outward from the outer radius of the charge case 32.

Figure 5:
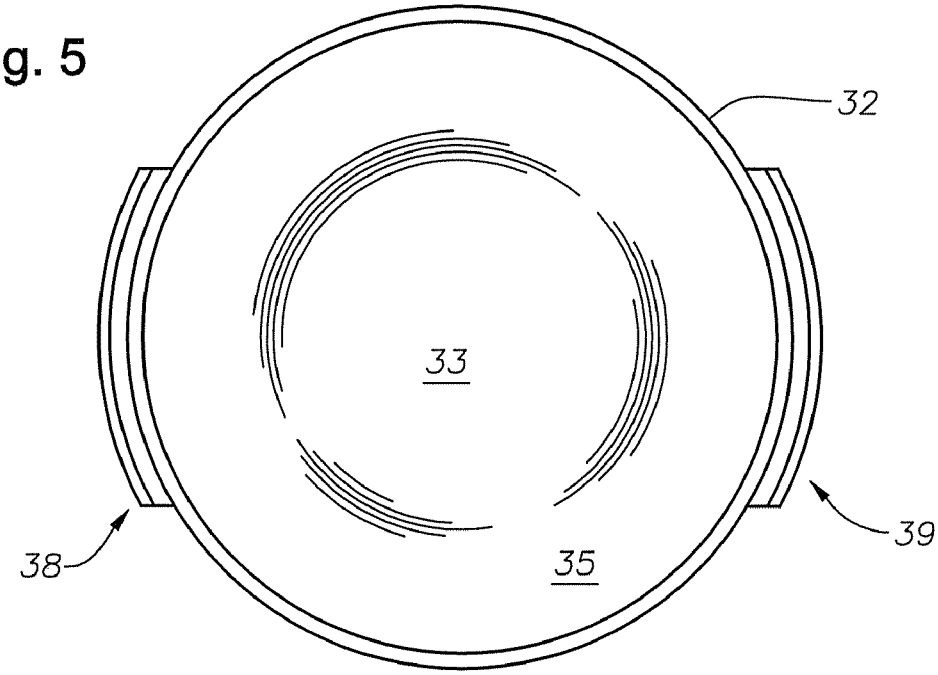
FIG. 5 is an overhead view of an embodiment of shaped charge case.

FIG. 5 provides an overhead view looking along the axis $A_x$ of the charge case 32 and through its opening. In this embodiment, two boss elements (38, 39) extend outward from the outer radius of the charge case 32 and along a portion of its outer radius. The boss elements (38, 39) may each extend from about 10% to about 30% of the charge case 32 circumference. In one embodiment, the bosses (38, 39) each extend approximately 20% of the charge case 32 circumference.

Figure 6:
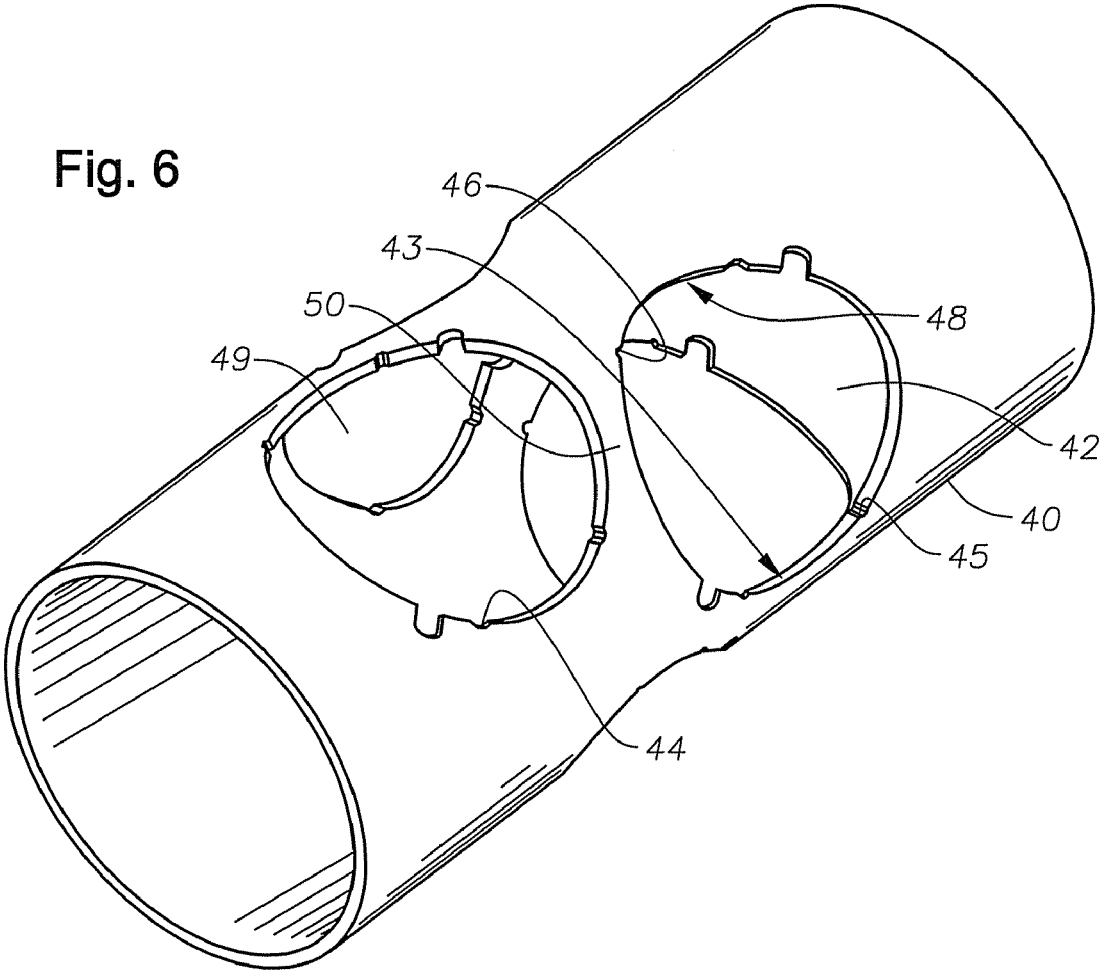
FIG. 6 is a perspective view of a gun tube formed to receive a shaped charge case formed in accordance with the present disclosure.

FIG. 6 illustrates a perspective view of an example of a gun strip 40 combineable with the charge cases 32 of FIGS. 4 and 5. The gun strip 40 illustrated is an annular member provided with holes 42 configured to receive the charge cases 32 therein. Landings (43, 48) are formed in the gun strip 40 on the gun strip 40 body adjacent the outer circumference of the holes 42. In the embodiment of FIG. 6, the landings (43, 48) comprises notches (44, 45, 46, 47) configured to cooperatively mate with respective ends of the bosses (38, 39). The landings (43, 48) may also optionally provide a planar surface (rather than the angular outer surface of the gun strip 40) in the region of the gun strip 40 between the notches (45, 45, and 46, 47). The cooperative mating between the bosses (38, 39) and the landings (43, 48) orients the shape charge 32 within the gun strip 40 without mechanically affixing the charge case 32 to the gun strip 40. The cooperative mating restricts charge case 32 radial movement within the holes such that the charge case is maintained in alignment until it is mechanically affixed or otherwise fastened to the gun strip 40.

Figure 7:
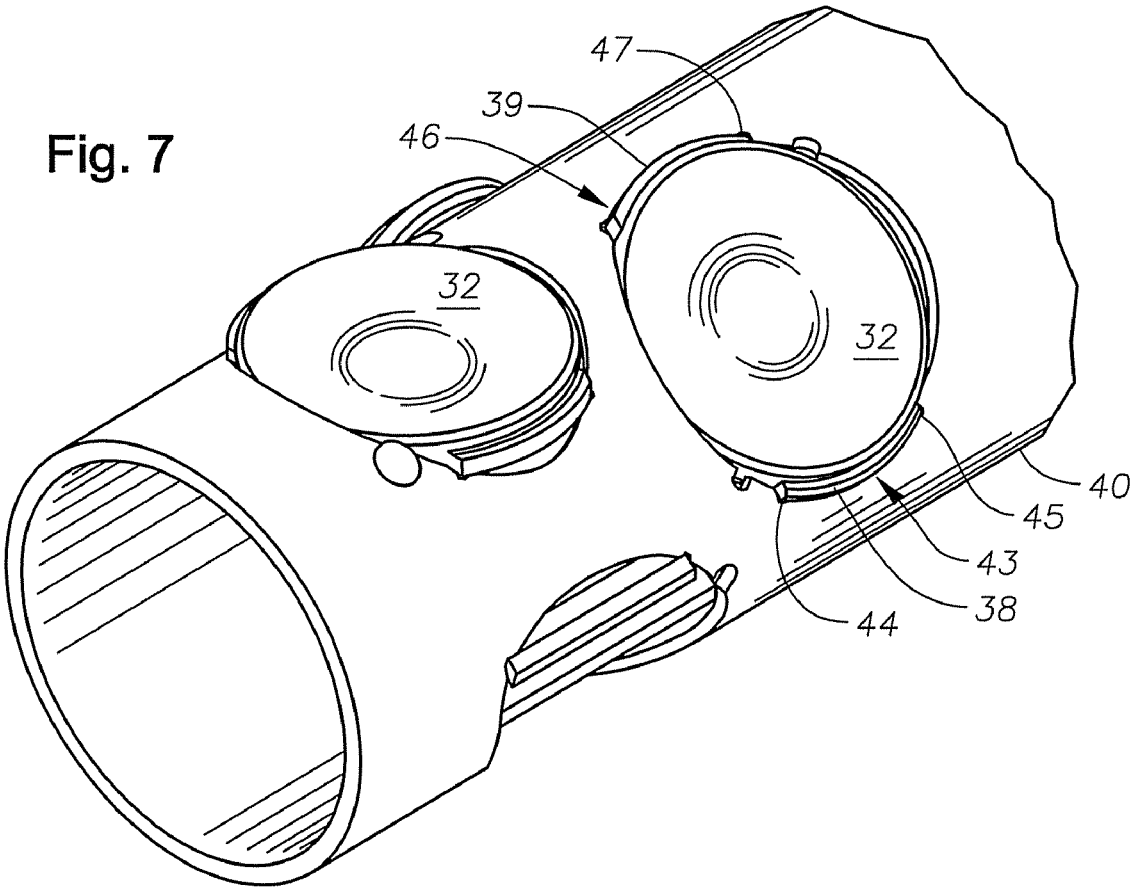
FIGS. 7 and 8 are respectively perspective and axial views of an embodiment of a gun strip with shaped charges.

Provided in FIG. 7 is a perspective view of the charge cases 32 formed in accordance with the present disclosure and positioned within a gun strip 40. As shown, the ends of the boss 38 are received within the notches (44, 45) of the landing 43. The cooperative mating between the boss 38 and boss 39 and the landings (43, 48) provides a novel manner of seating the charge case 32 within the gun strip 40.

For the purposes of discussion herein, a high density shot typically has at least 10-12 shaped charges per linear foot of perforating gun. In some instances however high density shots may include guns having as few as 6 shots per linear foot. Referring again to FIG. 6, the gun strip 40 provides an example of a high density configuration. As is the case in high density guns, first and second holes (42, 49) are disposed so that their respective peripheries are proximate to one another thereby leaving a relatively narrow strip of gun strip material between the holes. The placement of these holes (42, 49) defines a web 50 which comprises the gun body material between these two adjacent holes (42, 49). As noted above, certain high density configurations result in a web lacking sufficient structural integrity to support charges within the particular gun strip. However, another advantage of the charge case disclosed herein is realized by configuring the holes such that the respective landings are disposed on the hole periphery away from the web 50. In the embodiment of FIG. 6, the landings of the holes (42, 49) are disposed at roughly 90° or more from the midpoint of the web 50. Since the bosses (38, 39) are aligned with the landings (43, 48) the bosses (38, 39) are therefore also away from the web 50. Accordingly, use of the embodiments described herein results in a gun tube having web dimensions producing sufficient structural integrity, even in the case of a high density configuration.

Figure 8:
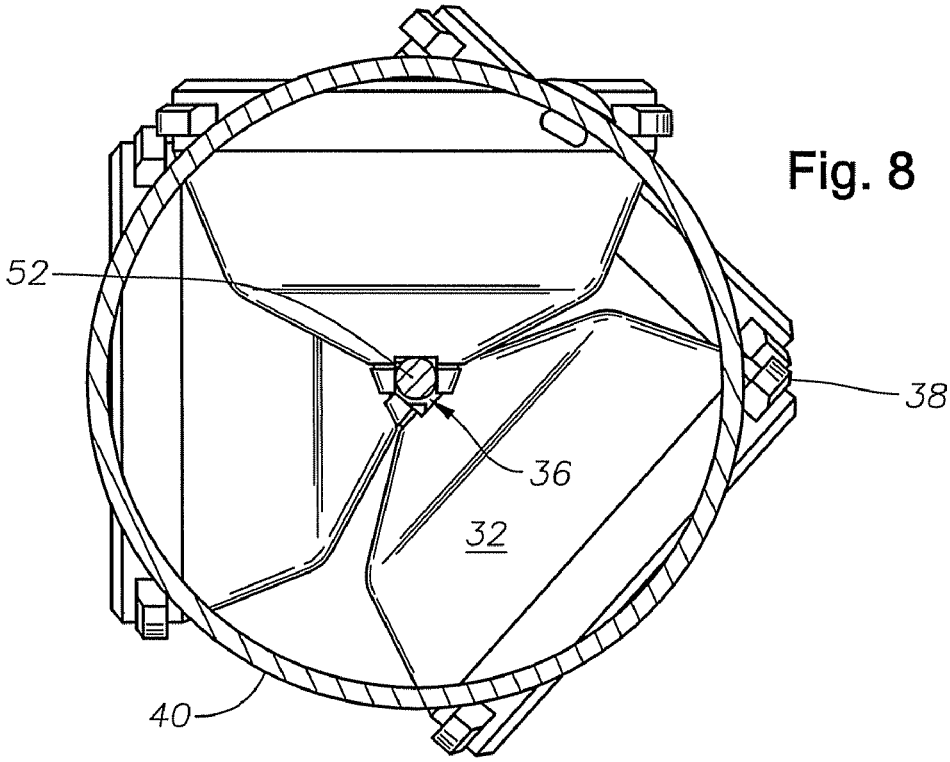

FIG. 8 provides a view looking along the axis of the gun strip 40 having multiple charge casings 32 disposed therein. In this view, a detonation cord 52 is shown coupled with the tabs 37 and cord slot 36 of the respective charge casings 32. The respective cord slots 36 of each charge case 32 are aligned for receiving the detonation cord 52 therethrough. Aligning the cord slots 36 to readily receive the detonation cord greatly increases the ease of attaching the perforating cord 52 to each charge case 32, thereby significantly reducing the time required to assemble a perforating gun. The alignment of each of the cord slots 36 of the charge casings 32 in the gun strip 40 is accomplished by an appropriate placement of the boss of each charge case, and the landings in which the charge case 32 is cooperatively mated with. The cord slot 36 alignment described above can be accomplished in conjunction with forming a high density perforating gun and can also be accomplished for charge cases used in applications that are not high density. Thus use of the boss and/or landings described herein is useful for forming high density perforating guns and for pre-aligning charge cases so their respective cord slots may readily receive a detonation cord.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A perforating gun comprising:

shaped charges, each having, a charge case with a bottom portion, a liner, and explosive disposed between the liner and charge case;

an annular gun strip;

a pair of bosses extending outward from each charge case;

at least three holes formed through the side of the gun strip that define webs between the holes; and landings on the gun strip and adjacent each hole and directed away from one of the webs.

2. The perforating gun of claim 1, wherein the bosses have ends that are substantially equidistant from one another.

3. The perforating gun of claim 2, wherein the lengths of the bosses each ranges from about 10% to about 30% of the charge case circumference.

4. The perforating gun of claim 2, wherein the lengths of the bosses are each about 20% of the charge case circumference.

5. The perforating gun of claim 1, wherein the charge case has an open end and a closed end, and an axis extending through the open and closed ends, the charge case being substantially symmetric about the axis.

6. The perforating gun of claim 1, wherein the bosses are elongated and extending generally perpendicular to an axis extending through the charge case.

7. The perforating gun of claim 1, wherein the landings are disposed away from the webs at an angle of at least about 90°.

8. The perforating gun of claim 7, wherein the web dimensions comprise structural integrity sufficient for a high density perforating gun.

9. The perforating gun of claim 1, wherein the landings comprises notches configured to mate with ends on each boss.

10. The perforating gun of claim 9, wherein a portion of the gun strip body between the notches is substantially planar.

11. The perforating gun of claim 1, wherein the plurality of shaped charges and holes thereby form a high density perforating gun.

12. A method of forming a wellbore perforating device comprising:

(a) providing shaped charges with bosses that partially circumscribe the outer periphery of each shaped chare;

(b) providing an annular gun strip with three holes though the sidewall of the gun strip that define webs between the holes, an axis, and landings formed adjacent the hole edge and located away from the webs;

(c) inserting the shaped charges into the gun strip hole; and (d) cooperatively mating the bosses with the landings so that the bosses are directed away from an adjacent web.

13. The method of claim 12, wherein the web dimensions are sufficient for use in a high density perforating gun application.

14. The method of claim 12 further comprising deploying the perforating device within a wellbore and initiating detonation of the shaped charges.

15. A high density perforating gun comprising:

an annular gun tube having three holes formed through the side wall defining webs in the gun tube between adjacent holes;

a detonating cord in the gun tube;

landings provided on the outer periphery of the holes that are set at least 90° from a web adjacent the hole; and shaped charges inserted in the holes and having a charge case with a bottom portion and an open end opposite the bottom portion, a boss extending radially outward from a side of the charge case proximate the open end, high explosive and a liner inserted in the open end, parallel tabs depending from the bottom portion, and ends on each boss mated with one of the landings.

16. The high density perforating gun of claim 15, wherein the shot density is selected from the list consisting of at least about six shots per linear foot, at least about ten shots per linear foot, and at least about twelve shots per linear foot.

* * * * *